US006705903B2

(12) United States Patent
Yu

(10) Patent No.: US 6,705,903 B2
(45) Date of Patent: Mar. 16, 2004

(54) ELECTRICAL CONNECTOR WITH STAGGERED PIN HOLES

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,104

(22) Filed: Mar. 21, 2002

(65) Prior Publication Data

US 2003/0119380 A1 Jun. 26, 2003

(51) Int. Cl.[7] ..... H01R 13/40
(52) U.S. Cl. ..... 439/733.1; 439/83
(58) Field of Search ..... 439/733.1, 444, 439/682, 79, 83

(56) References Cited

U.S. PATENT DOCUMENTS 3,905,665 A * 9/1975 Lynch et al. ..... 439/83
4,762,500 A * 8/1988 Dola et al. ..... 439/83
5,575,686 A * 11/1996 Noschese ..... 439/74
5,836,773 A * 11/1998 McHugh et al. ..... 439/733.1
6,152,766 A * 11/2000 Wu et al. ..... 439/570
6,491,536 B1 * 12/2002 Torii ..... 439/83

* cited by examiner

*Primary Examiner*—P. Austin Bradley
*Assistant Examiner*—Briggitte R. Hammond
(74) *Attorney, Agent, or Firm*—Wei Te Chung

(57) ABSTRACT

An electrical connector includes a housing and a plurality of contacts. The housing includes a bottom wall, longitudinal side walls, and end walls extending from peripheral of the bottom walls. A plurality of pin holes defined in the bottom wall and a plurality of ribs alternatively extended over the inner surface of the side walls corresponding to the pin holes. The contact portions of the contacts supported securely by the plateaus and the valleys which defined by the ribs.

6 Claims, 5 Drawing Sheets

ELECTRICAL CONNECTOR WITH STAGGERED PIN HOLES

BACKGROUND OF THE INVENTION

1. Field of the Invention

The present invention relates to electrical connectors, and more particularly to an electrical connector having high density contacts and pin holes for transferring more information.

2. Description of the Related Art

With the development of electronic technology and information technology, more and more information is required to transmit between different electronic devices. On the other hand, it is a trend of miniaturization in electronic industry. Therefore, it is desired that an electrical connector used to connect between two electronic devices has a compact configuration.

Referring to FIG. 5, a conventional electrical connector has a housing 100 and a plurality of contacts (not shown). The housing 100 defines a plurality of rectangular pin holes 120 arranged in two rows in opposite sides for receiving the contacts therein. A pitch between two adjacent pin holes is about 0.5 mm. If the pitch is minished, the configuration strength will be reduced and thus the portion between the two adjacent pin holes is brittle. Thus, the amounts of the contacts and the distributing position of the pin hole cannot offer enough information for high-tech products. Furthermore, the pitch of 0.5 mm adversely affects the compact configuration of the electrical connector.

SUMMARY OF THE INVENTION

Accordingly, an object of the present invention is to provide an electrical connector having high density contacts and pin holes for miniaturization of the electrical connector.

Another object of the present invention is to provide an electrical connector having high density contacts and pin holes for offering enough information for high-tech products.

In order to achieve the above-mentioned object, an electrical connector with the present invention includes a housing and a plurality of contacts. The housing includes a bottom wall, a pair of side walls extending from opposite sides of the bottom wall, and a pair of end walls extending between the side walls. Each side of the bottom wall defines a plurality of stagger pin holes receiving the contacts therein.

Other objects, advantages and novel features of the present invention will be drawn from the following detailed description of preferred embodiments of the present invention with attached drawings, in which:

DETAILED DESCRIPTION OF THE PREFERRED EMBODIMENTS

Figure 1:
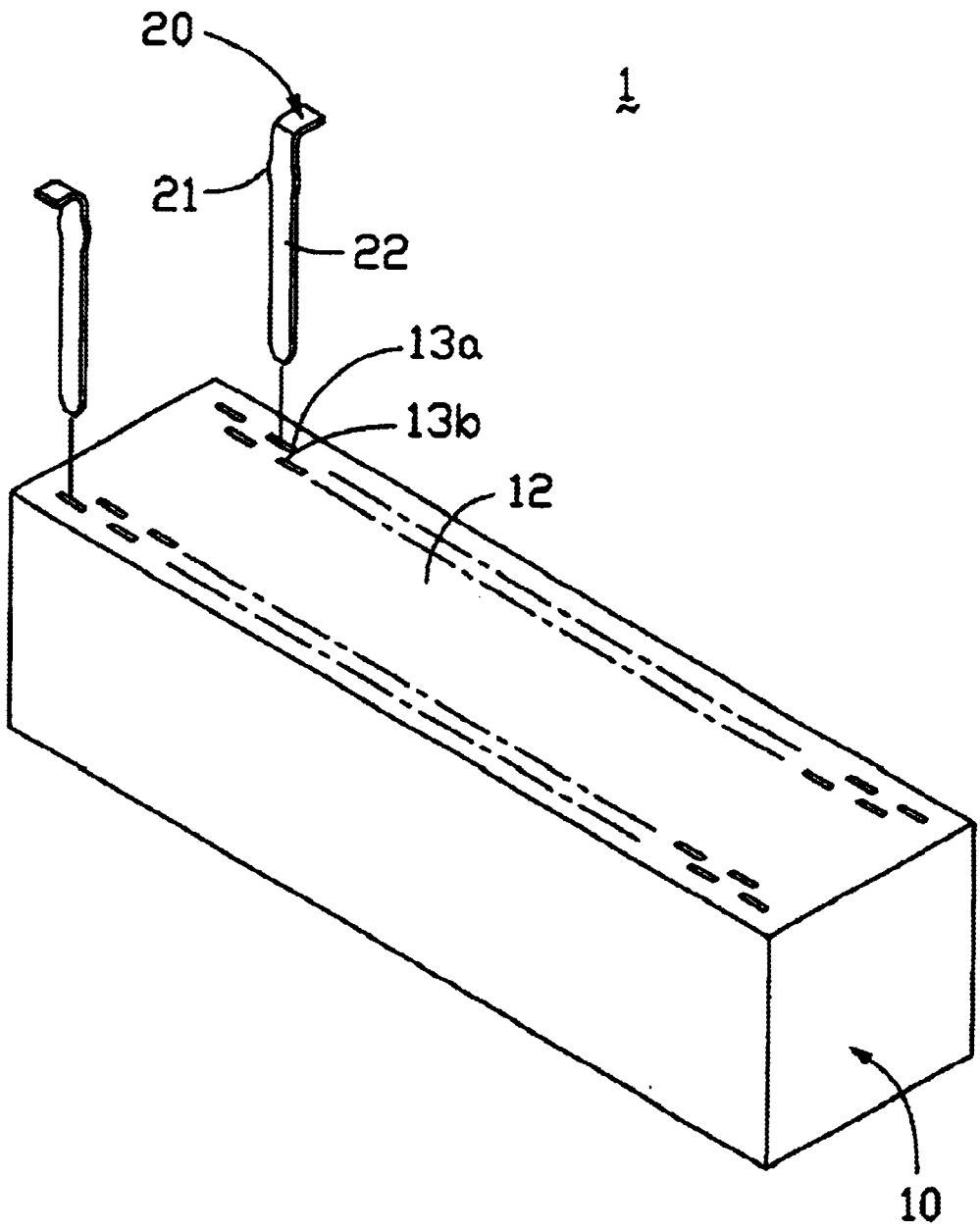
FIG. 1 is an exploded perspective view of an electrical connector in accordance with the present invention.
Figure 2:
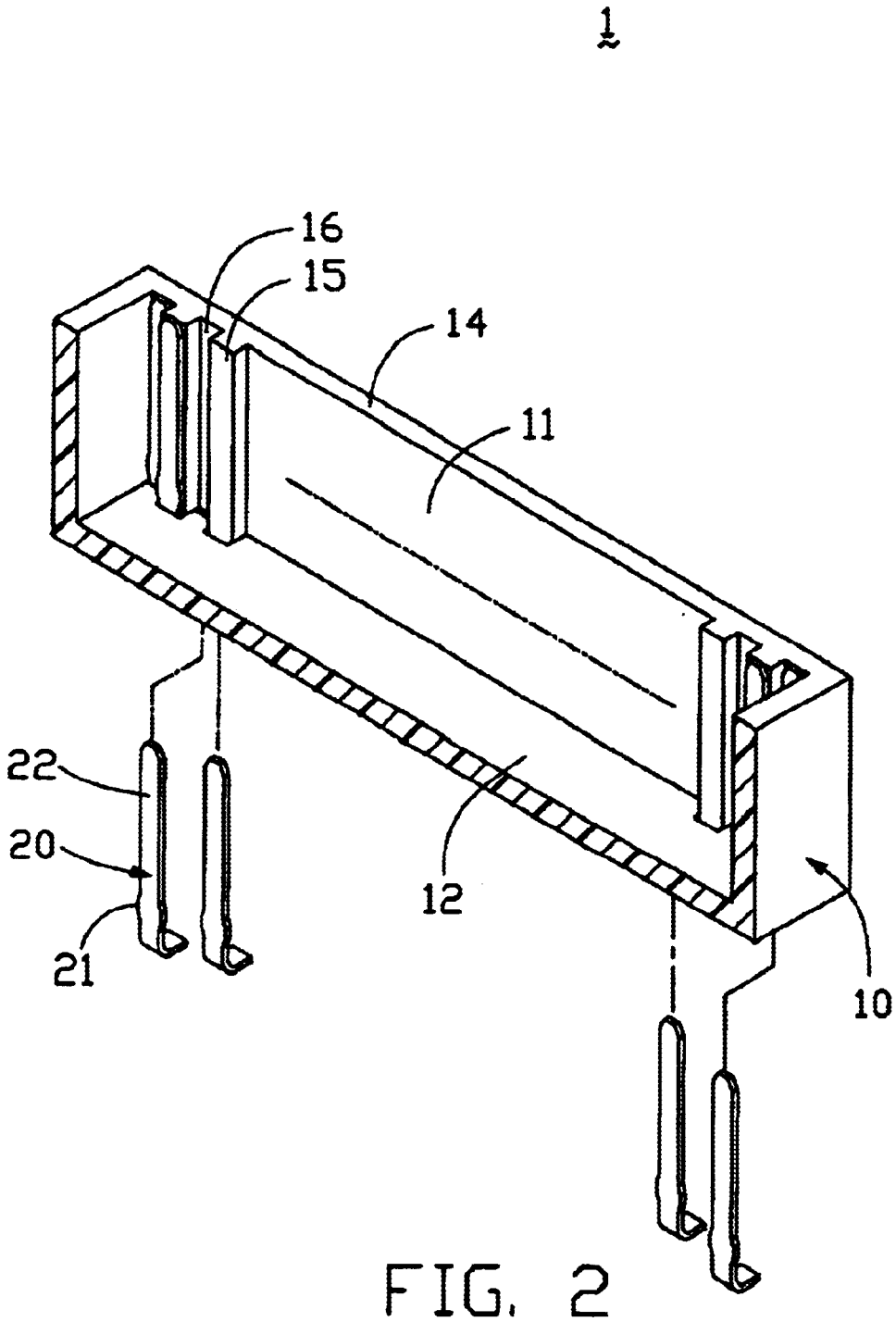
FIG. 2 is an exploded perspective view of an electrical connector in accordance with a first embodiment of the present invention with a section cut away.

Referring to FIGS. 1 and 2, an electrical connector 1 in accordance with a first embodiment of the present invention includes an insulative housing 10 and a plurality of electrical contacts 20. The housing 10 includes a bottom wall 12, a pair of side walls 14 extending from opposite sides of the bottom wall 12, and a pair of end walls (not labeled) extending from opposite ends of the bottom wall 12 and connected between the side walls 14. Therefore, an elongate receiving slot 11 is defined in the housing 10 for receiving a complementary connector (not shown). Two rows of elongate pin holes 13*a*, 13*b* staggered relative to each other are defined in each side of the bottom wall 12. Each side wall 14 forms a plurality of spaced ribs 15 corresponding the pin holes 13*b*. Therefore, a plurality of spaced recesses 16 is defined in the side wall 14 corresponding to the pin holes 13*a*.

Each contact 20 includes a securing portion 21 engagingly received in the corresponding pin hole 13*a* or 13*b*, and a mating portion 22 extending from the securing portion 21. The contacts extending through the pin holes 13*a* are received in the recesses 16 and abut against the side wall 14. The contacts extending through the pin holes 13*b* abut against the ribs 15 of the side wall 14. Thus, the pin holes 13*a*, 13*b* and contacts 20 are compact thereby maximizing the capacity of information transmission of the connector 1. Furthermore, the configuration of the electrical connector 1 is miniaturized.

Figure 3:
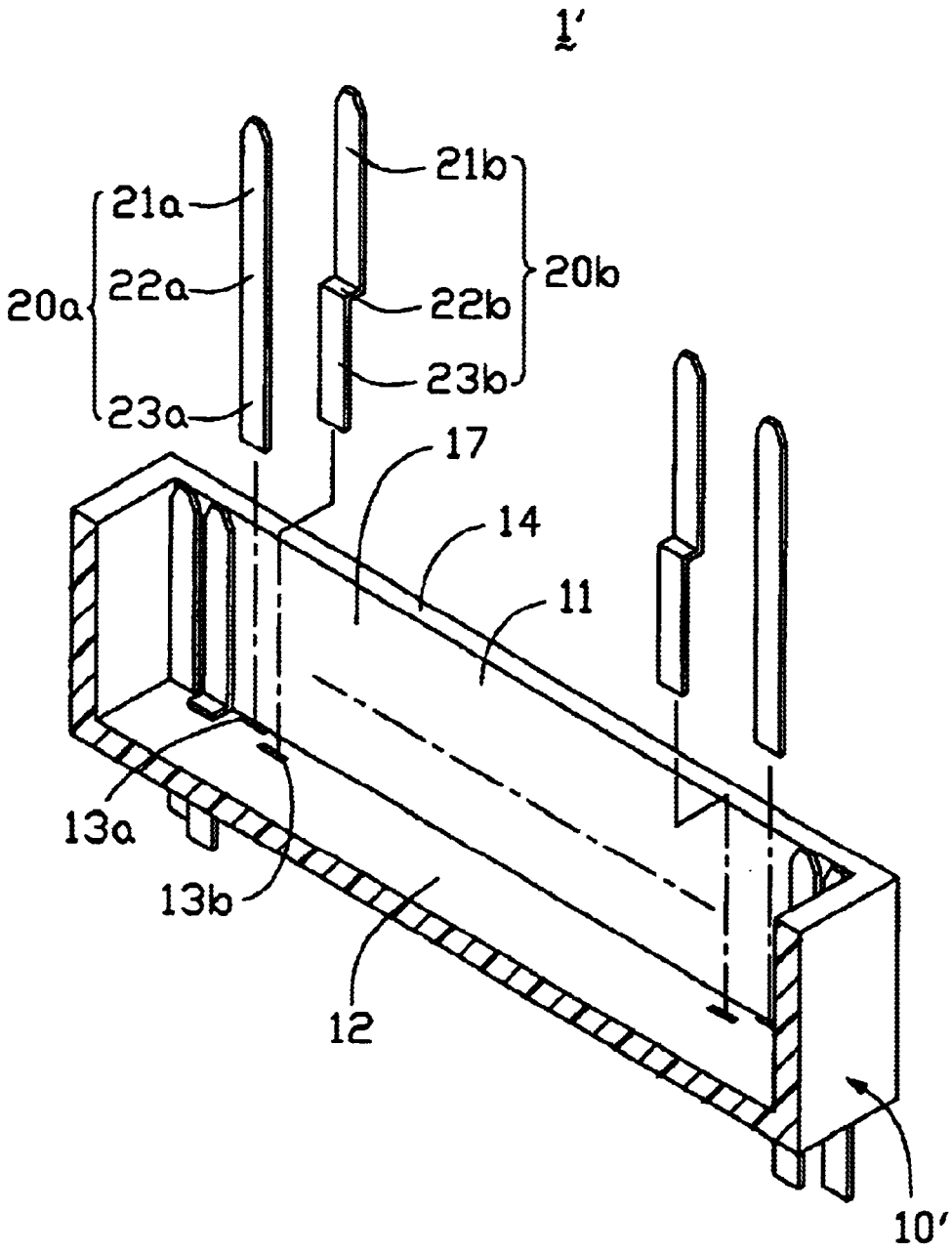
FIG. 3 is an exploded perspective view of an electrical connector in accordance with a second embodiment of the present invention with a section cut away.

Referring to FIG. 3, an electrical connector in accordance with a second embodiment of the present invention includes a housing 10', and a plurality of first contacts 20*a* and a plurality of sccond contacts 20*b* received in the housing 10'. A bottom wall 12 of the housing 10' defines staggered elongate pin holes 13*a*, 13*b* in each side thereof. Each of side walls 14 extending from the bottom wall 12 has a planar inner surface 17. Each first contact 20*a* comprises a base portion 22*a* engagingly received in a corresponding pin hole 13*a*, a contact portion 21*a* extending from a top of the base portion 22*a*, and a tail portion 23*a* depending from a bottom of the base portion 22*a*. Each second contact 20*b* comprises a contact portion 21*b*, a shoulder 22*b* bendingly extending from a bottom of the contact potion 21*b*, and a tail portion 23*b* depending from a bottom of the shoulder 22*b*. The first contacts 20*a* extend through the pin holes 13*a* and abut against the inner surface 17 of the side wall 14. The second contacts 20*b* extend through the pin holes 13*b* and abut against the inner surface 17 of the side wall 14 with die shoulder 22*b* thereof being supported by the bottom wall 12. Thus, the pin holes 13*a*, 13*b* and first and second contacts 20*a*, 20*b* are compactly arranged thereby maximizing the capacity of information transmission of the connector 1'. Furthermore, the configuration of the electrical connector 1' is miniaturized.

Figure 4:
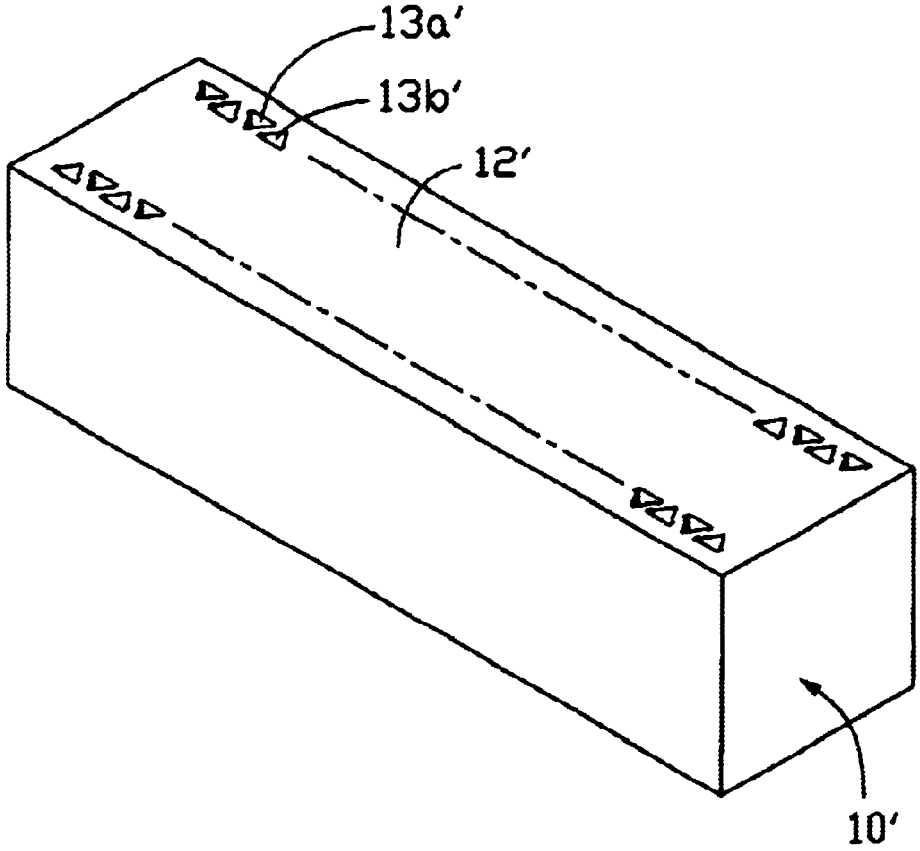
FIG. 4 is a perspective view of a housing of an electrical connector in accordance with a further embodiment of the present invention.
Figure 5:
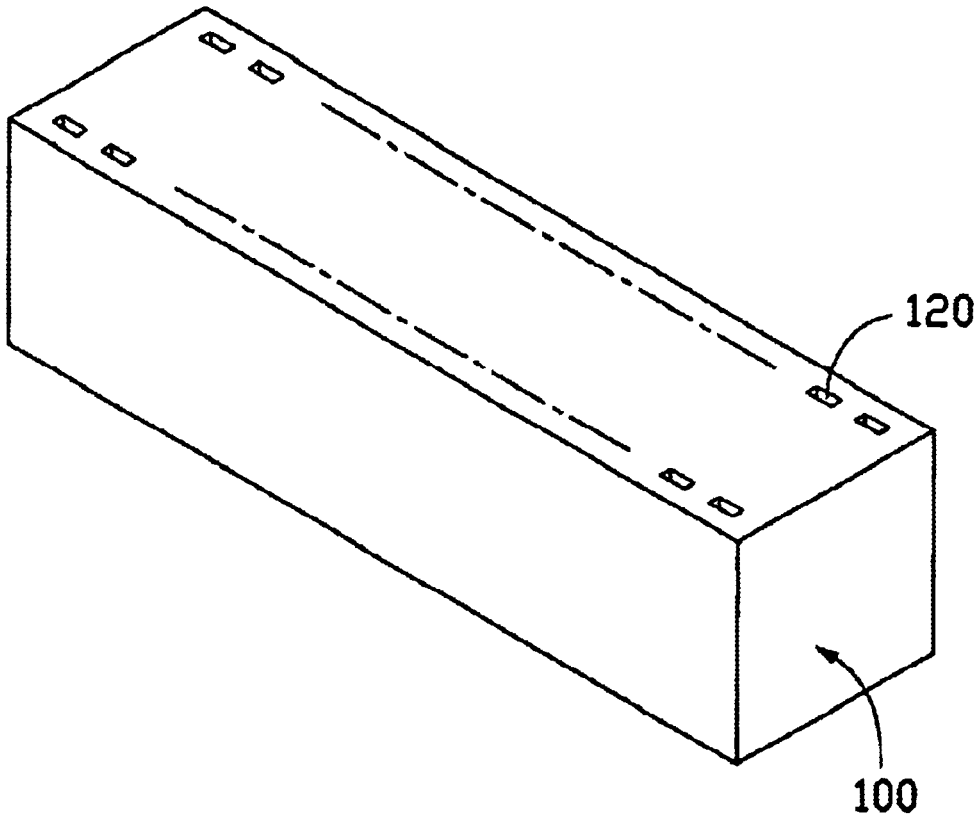
FIG. 5 (PRIOR ART)
FIG. 5 is a perspective view of a housing of a conventional electrical connector.

Also referring to FIG. 4. in a third embodiment of the present invention, the housing 10' has substantially all the parts of the above-mentioned housing 10' of the second embodiment of the present invention, except for the elongated holes 13*a*, 13*b*. A plurality of isosceles triangular pin holes 13*a'*, 13*b'* is defined in the bottom wall 12 of the housing 10'. Every two adjacent pin holes 13*a'*, 13*b'* are oriented in opposite directions to each other. A partition wall between every two adjacent pin holes 13*a'*, 13*b'* is oblique-lyoriented relative to a lengthwise direction of the housing 10'.

It is noted that the traditional high density staggered arrangement for the contact tails may have limitations due to tiny dimension of the corresponding core pins, which form the pin holes in the housing, tending to break. Oppositely, using the large dimensioned core pins to form such pin holes may result in interference between every adjacent two pin holes because of fine pitch arrangement thereof. Thus, using the alternating triangular core pins to form the corresponding alternating triangular pin holes for retaining the corresponding staggered contact tails therein, may comply with the fine pitch requirement while still maintaining the sufficient partition wall thickness between every adjacent two pin holes for strength of the whole connector housing. Understandably, the pin holes with other shapes which are arranged in an alternating/complementary manner to hold the staggered contact tails is included in this invention.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. An electrical connector comprising:

a housing having a bottom wall, longitudinal side walls and end walls extending from a periphery of the bottom wall, a plurality of pin holes defined in a staggered arrangement in the bottom wall; and a plurality of first contacts and a plurality of second contacts respectively received in the pin holes, the first contacts and the second contacts alternately arranged in a lengthwise direction of the housing;

wherein each of the first contacts comprises a base portion securely received in a corresponding pin hole, a contact portion supported by a corresponding side wall, and a tail portion protruding below the bottom wall; and each of the second contacts comprises a contact portion supported by a corresponding side wall, a tail portion protruding below the bottom wall, and a shoulder between the contact portion and the tail portion and supported by the bottom wall.

2. The electrical connector as claimed in claim 1, wherein each of the pin holes is substantially elongate.

3. The electrical connector as claimed in claim 1, wherein each of the pin holes is substantially triangular, and every two adjacent pin holes are oriented in opposite directions to each other.

4. An electrical connector comprising:

a housing defining a bottom wall, longitudinal side walls, and end walls extending from a periphery of the bottom wall;

a plurality of pin holes defined in the bottom wall;

a plurality of spaced ribs formed along inner surfaces of the side walls thereby defining a plurality of recesses, each of the recesses located between two adjacent ribs, the ribs and recesses being arranged corresponding to the pin holes; and a plurality of contacts assembled to the housing and extending through the pin holes of the bottom wall, certain of the contacts received in corresponding recesses and abutting against corresponding side walls, and certain other of the contacts abutting against corresponding ribs of the side walls.

5. An electrical connector comprising:

an insulative housing;

at least one row of pin holes arranged in a lengthwise direction of the housing, said pin holes being arranged in an alternating manner so as to have any two adjacent pin holes complementary with each other along said lengthwise direction;

at least one row of pins respectively disposed in said pin holes, the pins having tails extending out of the housing in a staggered manner along said lengthwise direction;

wherein every two adjacent pin holes are oriented in opposite directions to each other; and a partition wall between every two adjacent pin holes is obliquely oriented relative to said lengthwise direction.

6. The connector as claimed in claim 5, wherein each of said pin holes has a triangle cross-section.

* * * * *